US008139800B2

(12) United States Patent
Ho et al.

(10) Patent No.: US 8,139,800 B2
(45) Date of Patent: Mar. 20, 2012

(54) HEARING APPARATUS WITH A MAGNETICALLY ATTACHED BATTERY HOLDING DEVICE

(75) Inventors: Wai Kit David Ho, Singapore (SG); Wee Haw Koo, Singapore (SG); Beng Hai Tan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1066 days.

(21) Appl. No.: 12/070,480

(22) Filed: Feb. 19, 2008

(65) Prior Publication Data

US 2008/0199031 A1 Aug. 21, 2008

(30) Foreign Application Priority Data

Feb. 21, 2007 (DE) ..... 10 2007 008 551

(51) Int. Cl.
*H04R 25/00* (2006.01)

(52) U.S. Cl. ..... 381/324; 381/322; 381/323

(58) Field of Classification Search ..... 381/324
See application file for complete search history.

(56) References Cited

U.S. PATENT DOCUMENTS

| | | | | |
|---|---|---|---|---|
| 4,272,591 | A | 6/1981 | Brander | |
| 4,598,177 | A | 7/1986 | McGroarty et al. | |
| 5,404,105 | A | 4/1995 | Chari | |
| 5,531,954 | A | 7/1996 | Heide et al. | |
| 5,675,657 | A * | 10/1997 | Giannetti | 381/312 |
| 7,394,911 | B2 * | 7/2008 | Joergensen et al. | 381/322 |
| 7,441,917 | B1 * | 10/2008 | Underdown et al. | 362/103 |
| 2006/0056648 | A1 | 3/2006 | Linkenkaer-Hansen | |
| 2006/0280324 | A1 * | 12/2006 | Beck et al. | 381/312 |

FOREIGN PATENT DOCUMENTS

| | | | |
|---|---|---|---|
| DE | 197 56 992 | A1 | 7/1999 |
| DE | 10 2005 020 322 | A1 | 7/2006 |
| EP | 1496530 | A2 | 1/2005 |
| EP | 1874091 | A2 | 1/2008 |
| KR | 2003014072 | | 2/2003 |
| SE | 9804504 | A | 6/2000 |
| WO | WO9604117 | A1 | 2/1996 |

OTHER PUBLICATIONS

Communication/Search Report from European Patent Office, Sep. 6, 2011, pp. 1-4.

* cited by examiner

*Primary Examiner* — Jerome Jackson, Jr.

(57) ABSTRACT

A hearing apparatus is to be provided, with which the battery can be exchanged in an almost wear-free fashion. Provision is thus made to magnetically attach a battery compartment or a battery holding device in the housing of the hearing apparatus or hearing device. The battery holding device is inserted into an opening in the housing. A detachable magnetic connection realized by magnetic elements thus exists between the housing and the battery holding device, the principle force component of which runs in the insertion direction. It is thus possible to dispense with plug or snap connections for instance.

10 Claims, 1 Drawing Sheet

HEARING APPARATUS WITH A MAGNETICALLY ATTACHED BATTERY HOLDING DEVICE

CROSS REFERENCE TO RELATED APPLICATIONS

This application claims priority of German application No. 10 2007 008 551.8 filed Feb. 21, 2007, which is incorporated by reference herein in its entirety.

FIELD OF THE INVENTION

The present invention relates to a hearing apparatus with a housing and a battery holding device and/or battery compartment, which is attached to the housing. The term hearing apparatus is understood here to mean in particular a device which can be worn on the head, such as for instance a hearing device, a headset or earphones.

BACKGROUND OF THE INVENTION

Hearing devices are portable hearing apparatuses which are used to supply the hard-of-hearing. To accommodate the numerous individual requirements, different configurations of hearing devices such as behind-the-ear hearing devices (BTE), in-the-ear hearing devices (ITE), e.g. including conch hearing devices or channel hearing devices (CIC), are provided. The hearing devices designed by way of example are worn on the outer ear or in the auditory canal. Furthermore, bone conduction hearing aids, implantable or vibrotactile hearing aids are also available on the market. The damaged hearing is herewith either stimulated mechanically or electrically.

Essential components of the hearing devices include in principal an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic configuration is shown in the example in FIG. 1 of a behind-the-ear hearing device. One or a number of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is provided by a battery 5 which is likewise integrated into the hearing device housing 1.

The battery of a hearing device is located in many cases in a so-called battery door and/or battery compartment, which is used as a battery holding device. The battery is inserted into this battery door. It is then attached into the hearing device housing by means of swiveling, snapping or any other fashion. To this end, mechanical structures are needed, which are subject to wear and tear over the course of time. Numerous battery exchange processes correspondingly result in a high degree of wear, which negatively influences the holding mechanism and/or the insertion, snapping or swiveling forces.

In some circumstances, an excessively high degree of wear results in the hearing device housing or the battery door having to be changed. This is however associated with a high outlay.

The publication DE 197 56 992 A1 discloses a hearing device, the power supply of which is effected by a cylindrical coin cell. One of the electrical poles, which electrically contacts the coin cell, is a permanent magnet and permanently holds the coin cell. To guarantee removal of the coin cell, a lateral borehole is provided, which allows the coin cell to be lifted out. A needle can be used for this purpose.

The publication DE 10 2005 020 322 A1 also discloses an interface device for signal transmission between a hearing aid device and an external device. A signal transmission device can be detachably attached to the hearing aid device by means of a magnetic fastener.

SUMMARY OF THE INVENTION

The object of the present invention thus consists in proposing a hearing apparatus, with which numerous battery exchange cycles are possible and the wear remains here as minimal as possible.

In accordance with the invention, this object is achieved by a hearing apparatus with a housing and a battery holding device, which is fastened to the housing, with it being possible to insert the battery holding device into an opening in the housing, and a detachable magnetic connection existing between the housing and the battery holding device, the principle force components of said magnetic connection running in the insertion direction.

Magnetically attaching the battery holding device to the housing of the hearing apparatus advantageously results in a constant holding force being permanently maintained between the battery holding device and the housing. This also does not change during numerous removal and reinsertion processes. In particular, mechanical wear can thus herewith be practically avoided.

The opening in the housing is preferably slit-shaped and opens toward two sides so that the battery holding device can be held on these two sides during insertion into the opening. A simple mechanical guide is thus provided so that the magnetic linkage can be achieved in a targeted fashion.

The battery holding device can comprise two protrusions and the housing can have two grooves as a guide, into which the protrusions are guided during insertion. A mechanical guide, which guides the magnetic elements on to one another, can also be achieved in this way. Mechanical guidance can be achieved especially in combination with the afore-mentioned slit-shaped opening, said mechanical guide only allowing a one-dimensional movement.

The hearing apparatus according to the invention can if necessary be equipped with an exchangeable module instead of the battery holding device and/or battery door, said exchangeable module exhibiting the same exterior dimensions as the battery holding device and being insertable into the opening instead of the battery holding device. The battery interface thus becomes a multi-functional interface. In particular, the exchangeable module can have an audio-input functionality, with corresponding electrical plug contacts being arranged on the exchangeable module as well as in the opening of the housing for the purpose of mutual contacting.

With a further embodiment of the present invention, a cavity can connect to the opening in the housing, the base of which is profiled in the insertion direction. This measure allows a polarity reversal of the battery to be prevented if the battery holding device can only be applied in precisely one position on the battery housing. A further advantage of this profiling consists in some circumstances in it not being possible to move the battery holding device at right angles to the magnetic force. This improves the holding characteristics of the battery holding device in the housing. It is particularly favorable if the base of the cavity is designed to be concave. This allows the battery holding device and/or the exchangeable module to be configured in a rounded fashion, so that it can be handled in a user-friendly fashion.

A magnet on the housing can also be arranged vertically to the opening through its center point. The battery holding device is herewith held centrally in the opening.

Furthermore, it is usually sufficient for the magnet to be significantly smaller than the opening. In particular, it is mostly sufficient if the surface of the magnet, viewed in the insertion direction, is less than 20 percent of the size of the opening in the housing. With corresponding mechanical guides, the magnetic connection can then also be produced more reliably and the magnet can be kept small, thereby being advantageous in terms of cost and weight.

BRIEF DESCRIPTION OF THE DRAWINGS

The present invention is now described in more detail with reference to the appended drawings, in which.

DETAILED DESCRIPTION OF THE INVENTION

The exemplary embodiments illustrated in more detail below represent preferred embodiments of the following invention.

Figure 1:
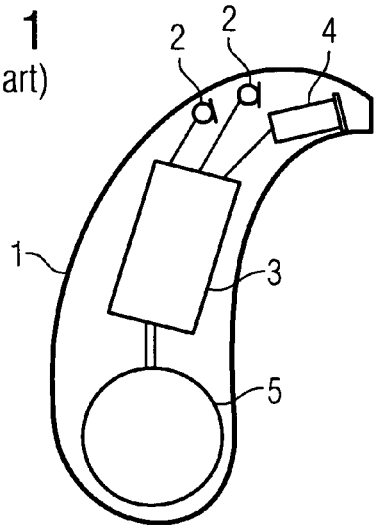
FIG 1 (Prior art)
FIG. 1 shows the basic design of a hearing device.
Figure 2:
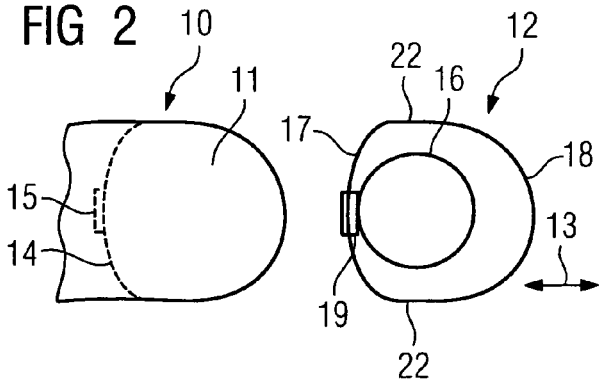
FIG. 2 shows a side view of a segment of a hearing device housing with a battery door as claimed in the present invention.

In accordance with the example in FIG. 2, a hearing device housing 10 is provided, which has a slit-shaped opening 11 on its end for insertion of a so-called 'battery door' 12. The insertion and/or removal direction is characterized in FIG. 2 with the arrow 13.

The base 14 of the opening 11 of the hearing device housing 10 is designed to be concave here. A first magnetic element 15 is arranged in the center of the base 14 at its lowest point. Its dimensions from the perspective of the insertion direction 13 are relatively small compared with the dimensions of the opening 11.

The battery door 12 has a recess, into which a battery 16 is inserted. Furthermore, the battery door 12 has a first surface segment 17, which corresponds to the base 14 in the hearing device housing 10 and is accordingly designed to be convex. The battery door 12 also has a second surface segment 18, which has the contour of the corresponding part of the hearing device housing 10. A second magnetic element 19 is arranged in the center of the first surface segment 17, said second magnetic element 10 attracting the first magnetic element 15 in the hearing device housing 10. At least one of the two magnetic elements 15, 19 is a magnet. The other magnetic element is then either ferromagnetic or a magnet with an opposite direction of polarity.

Figure 3:
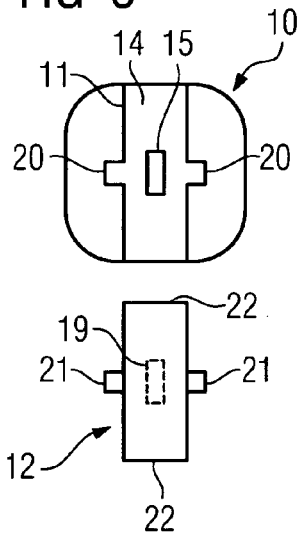
FIG. 3 shows a front side view of the housing and the battery door of FIG. 2.

FIG. 3 shows the front side of the hearing device housing 10 and the battery door 12. The slit-shaped opening 11 can be easily identified in the hearing device housing 10. The magnetic element 15 is located in the center of the base 14 of the opening 11.

For the sake of clarity, the battery door 12 is shown below the battery housing 10 in FIG. 3. On the basis of the view from the front side, the second magnetic element 19 is illustrated there with a dashed line.

The slit-shaped opening 11 represents a mechanical guide during insertion of the battery door 12 into the opening, said mechanical guide allowing no degree of freedom in the horizontal direction, in respect of FIG. 3. A movement of the battery door 12 in the vertical would still be possible. To prevent this vertical movement during insertion of the battery door 12 into the opening 11 of the hearing device housing 10, the hearing device housing 10 has guide grooves 20 on the inner sides of the opening 11, which run in the insertion direction 13. To this end, the battery door 12 has matching protruding guide elements 21. These are guided into the grooves 20 of the hearing device housing 10 during insertion of the battery door 12. A movement of the battery door 12 in the vertical direction is thus also prevented. This means that the battery door 12 is still only able to move in one direction 13, i.e. in one dimension, during insertion. Subsequently, the magnetic element 19 is guided in a targeted fashion onto the magnetic element 15, so that the magnetic connection can be produced in a reliable and simple fashion.

Figure 4:
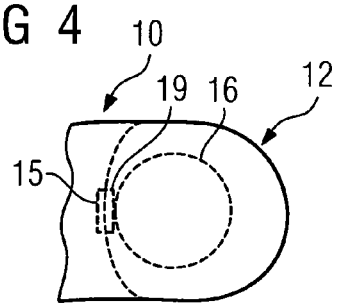
FIG. 4 shows a side view of the battery holding device in FIG. 2 in an inserted state and FIG. 5 shows a side view of an exchangeable module.

FIG. 4 shows the state in which the battery door 12 including the battery 16 is inserted into the hearing device housing 10. The two magnetic elements 15, 19 are linked to one another by means of magnetic forces. The surface of the hearing device housing 10 is flush with that of the battery door 12. The battery door 12 can be easily removed by pulling the battery door 12 out of the opening 11 in the opposite direction. In this process, the battery door 12 can be grasped with two fingers on the free surfaces 22 (cf. FIGS. 2 and 3). For this purpose, the surfaces can be designed accordingly in a non-slip manner.

Figure 5:
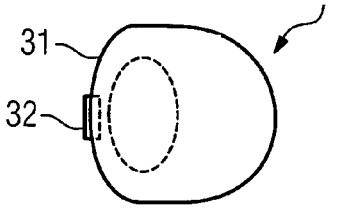

Instead of the battery door 12, an exchangeable module 30 shown in FIG. 5 can also be inserted into the opening 11 of the hearing device housing 10. This also has a corresponding surface segment 31, which corresponds to the base 14 of the opening 11. A magnetic element is likewise provided on this surface segment 31, in order to be able to produce the corresponding magnetic connection to the magnetic element 15. The magnetomechanical interface of the exchangeable module 30 is thus the same as that of the battery door 12. The exchangeable module 30 can itself have any function. It can thus be configured as an audio shoe or computer interface, Bluetooth interface or suchlike for instance.

The invention claimed is:

1. A hearing apparatus, comprising:

a housing; and a battery holding device that is fastened to the housing and is removably insertable into an opening of the housing by a detachable magnetic connection having a principle magnetic force component in a direction of the insertion, the battery holding device comprising a battery and two protrusions;

wherein a cavity connects to the opening of the housing and a base of the cavity is profiled in a direction of the insertion, and wherein the housing comprises two grooves to guide the protrusions during the insertion into the opening.

2. The hearing apparatus as claimed in claim 1, wherein the opening in the housing is slit-shaped and is open toward two sides so that the battery holding device is held on the two sides during the insertion into the opening.

3. The hearing apparatus as claimed in claim 1, further comprising an exchangeable module that has same exterior dimensions as the battery holding device and can be inserted into the opening.

4. The hearing apparatus as claimed in claim 3, wherein the exchangeable module comprises an audio input functionality and an electrical plug contact for contacting to another electrical plug contact arranged in the opening of the housing.

5. The hearing apparatus as claimed in claim 1, wherein the base of the cavity is concave.

6. The hearing apparatus as claimed in claim 1, wherein the housing comprises a magnet and the battery holding device comprises another magnet.

7. The hearing apparatus as claimed in claim 6, wherein the magnet on the housing is vertically arranged to the opening of the housing through a center point.

8. The hearing apparatus as claimed in claim 6, wherein the magnet on the housing is smaller than the opening.

9. A method for magnetically attaching a battery holding device to a housing of a hearing apparatus, comprising:

arranging a first magnet on the housing of the hearing apparatus;

arranging a second magnet in the battery holding device;

inserting the battery holding device into an opening of the housing by a magnetic force generated by the magnets between the housing and the battery holding device having a principle magnetic force component in a direction of the insertion such that the second magnet contacts the first magnet at a rearmost point of the opening, arranging two protrusions on the battery holding device;

arranging two grooves on the housing; and guiding the protrusions by the grooves during the insertion into the opening.

10. A hearing apparatus, comprising:

a housing having a cavity; and a battery holding device removably insertable into the cavity of the housing by a detachable magnetic connection having a principle magnetic force component in a direction of the insertion, the battery holding device comprising a battery;

wherein a base of the cavity is profiled in a direction of the insertion;

wherein the battery holding device comprises at least two protrusions, wherein the at least two protrusions comprise at least one protrusion extending from each of opposed sides of the battery holding device;

wherein the housing comprises at least two grooves configured to receive the at least two protusions, and wherein the at least two protrusions are configured for slidable movement within the at least two grooves to allow for the insertion of the battery holding device into the housing.

* * * * *